US010706725B2

(12) United States Patent
Park et al.

(10) Patent No.: US 10,706,725 B2
(45) Date of Patent: Jul. 7, 2020

(54) SHIP-COLLISION AVOIDANCE GUIDING SYSTEM USING TIME SERIES GRAPHIC DISPLAY

(71) Applicant: Korean Institute of Ocean Science & Technology, Daejeon (KR)

(72) Inventors: Jin Hyoung Park, Daejeon (KR); Hong Tae Kim, Daejeon (KR); Han Jin Lee, Daejeon (KR); Deuk Jae Cho, Daejeon (KR); Jin Ki Jung, Daejeon (KR); Jun Hyuk Jang, Daejeon (KR)

(73) Assignee: Korean Institute of Ocean Science and Technology, Ansan-si (KR)

( * ) Notice: Subject to any disclaimer, the term of this patent is extended or adjusted under 35 U.S.C. 154(b) by 189 days.

(21) Appl. No.: 15/742,578

(22) PCT Filed: Jul. 5, 2016

(86) PCT No.: PCT/KR2016/007270
§ 371 (c)(1),
(2) Date: Jan. 8, 2018

(87) PCT Pub. No.: WO2017/007221
PCT Pub. Date: Jan. 12, 2017

(65) Prior Publication Data

US 2018/0190129 A1 Jul. 5, 2018

(30) Foreign Application Priority Data

Jul. 7, 2015 (KR) ..... 10-2015-0096634

(51) Int. Cl.
*G08G 3/02* (2006.01)
*B63B 49/00* (2006.01)
*B63B 45/00* (2006.01)

(52) U.S. Cl.
CPC ..... *G08G 3/02* (2013.01); *B63B 45/00* (2013.01); *B63B 49/00* (2013.01)

(58) Field of Classification Search
CPC ..... G08G 3/02; B63B 49/00; B63B 5/00
See application file for complete search history.

(56) References Cited

U.S. PATENT DOCUMENTS 3,725,918 A * 4/1973 Fleischer ..... G01S 13/937 342/41
5,370,074 A * 12/1994 Knudsen ..... B63C 11/48 114/312
2011/0063162 A1* 3/2011 Kojima ..... G01S 13/52 342/164

FOREIGN PATENT DOCUMENTS

JP 3134974 U 8/2007
KR 100562216 B1 3/2006
(Continued)

OTHER PUBLICATIONS

International Search Report PCT/ISA/210 for International Application No. PCT/KR2016/007270 dated Oct. 10, 2016.
(Continued)

*Primary Examiner* — Aaron L Troost
(74) *Attorney, Agent, or Firm* — Harness, Dickey & Pierce, P.L.C.

(57) ABSTRACT

A ship-collision prevention system and method for preventing a collision between ships at sea including a ship-collision avoidance guiding system using a time series graphic display, and guiding system displays, in a time series graph, depicting changes in relative distance according to time with respect to respective ships and obstacles on the basis of information provided from an electronic chart display and information system (ECDIS) and a radar system, wherein, whether other ships are on portside or starboard is displayed on the basis of radar information, and a notifica-
(Continued)

tion through an alarm or the like if a distance to a specific ship has matched a predetermined threshold value or less, and effectively preventing a collision between ships at sea, and simultaneously, enabling a simulation for a crossing event and avoidance by inputting a random value.

7 Claims, 4 Drawing Sheets

(56) References Cited

FOREIGN PATENT DOCUMENTS

| | | | |
|---|---|---|---|
| KR | 2011/0114078 | A | 10/2011 |
| KR | 101193081 | B1 | 10/2012 |
| KR | 101275277 | B1 | 6/2013 |
| KR | 101376928 | B1 | 3/2014 |
| KR | 2015/0050766 | A | 5/2015 |

OTHER PUBLICATIONS

Written Opinion of the International Searching Authority PCT/ISA/237 for International Application No. PCT/KR2016/007270 dated Oct. 10, 2016.

* cited by examiner

【Figure 1】
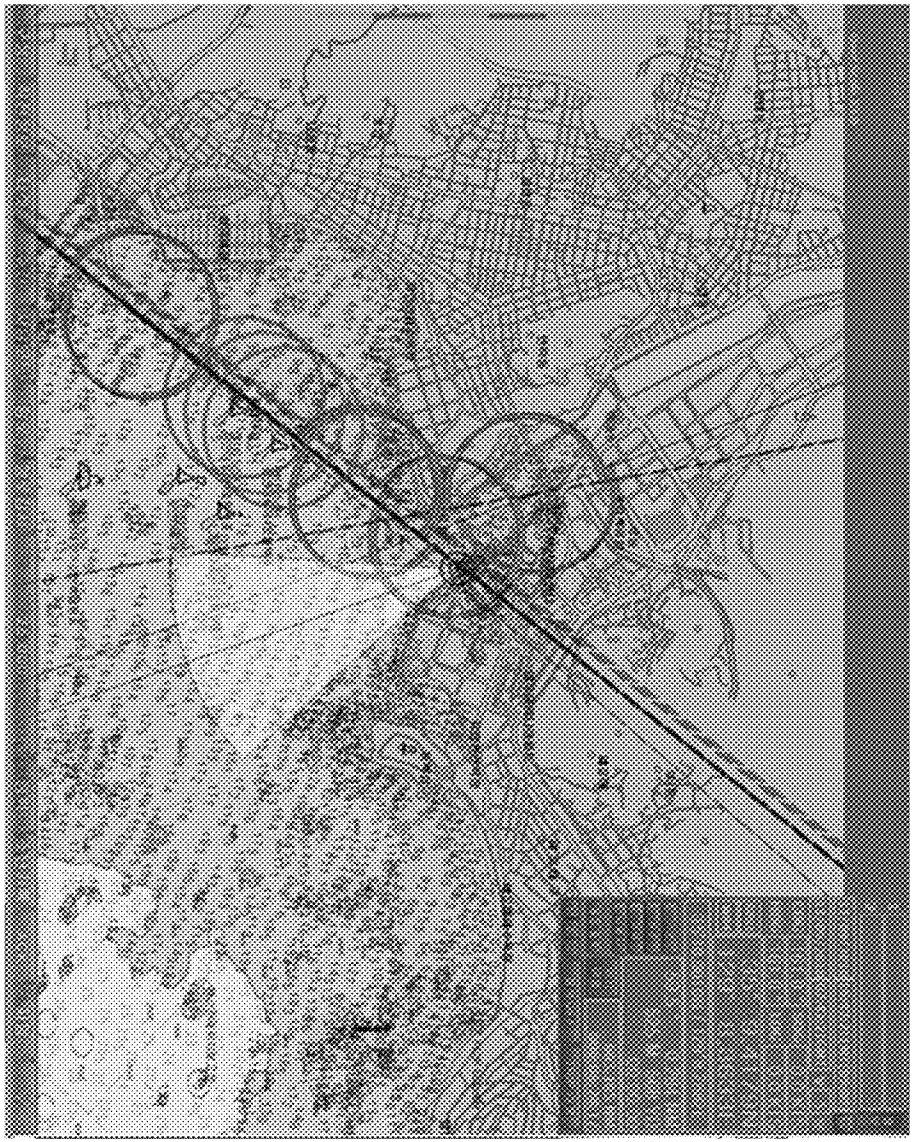

【Figure 2】
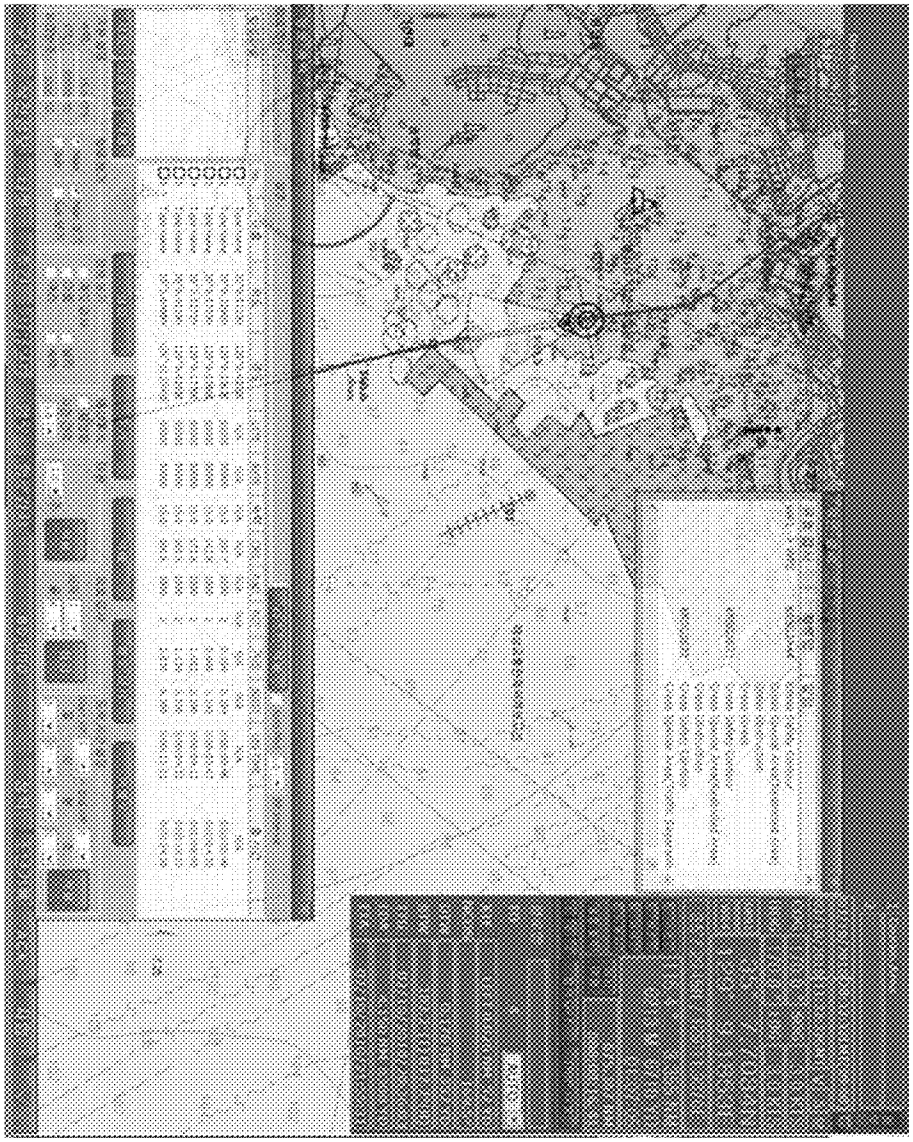

【Figure 3】
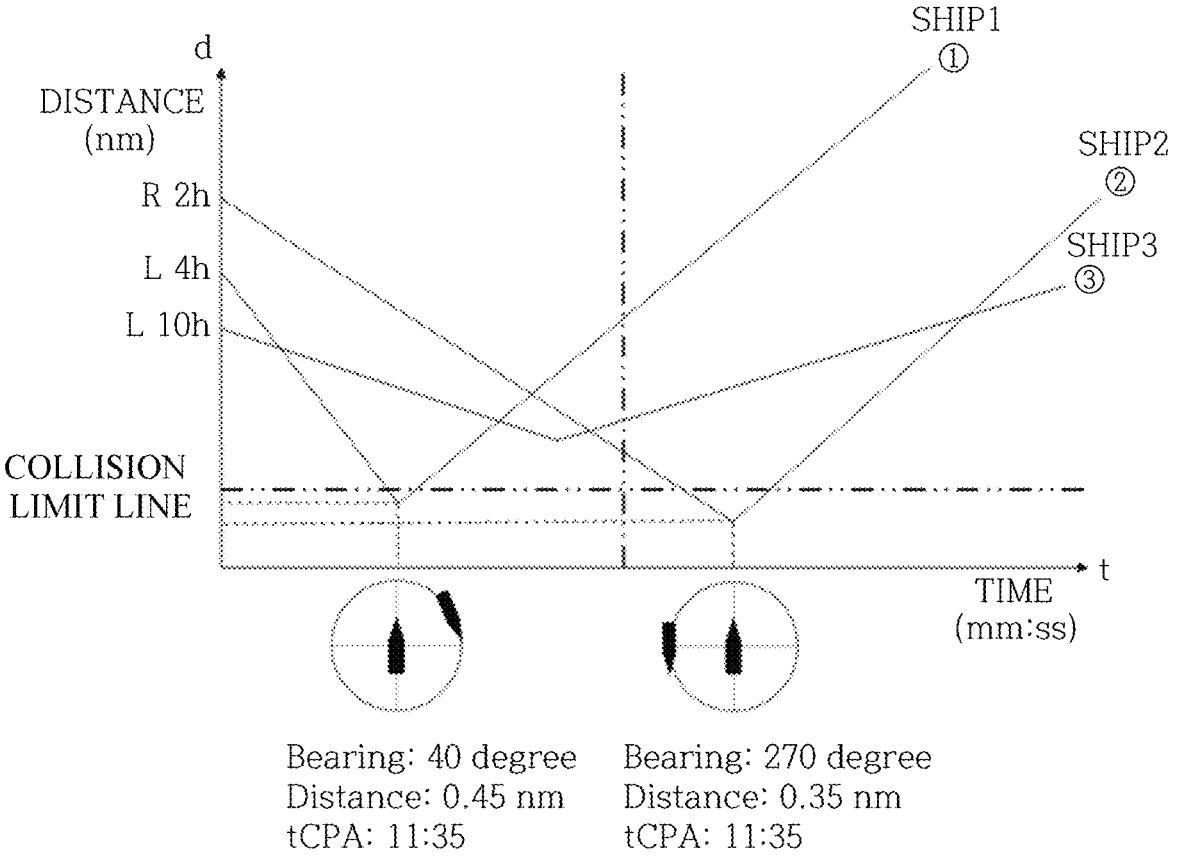

【Figure 4】
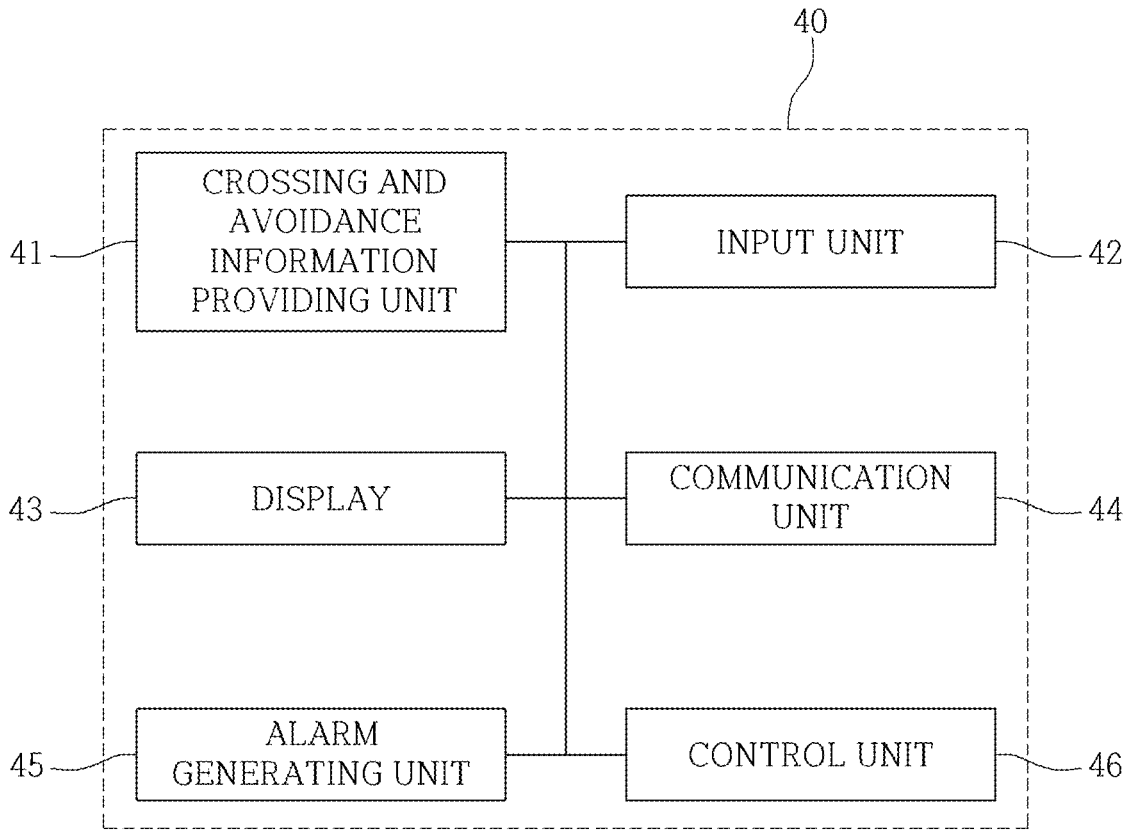

SHIP-COLLISION AVOIDANCE GUIDING SYSTEM USING TIME SERIES GRAPHIC DISPLAY

CROSS-REFERENCE TO RELATED APPLICATIONS

This application is a national phase under 35 U.S.C. § 371 of PCT International Application No. PCT/KR2016/007270 which has an International filing date of Jul. 5, 2016, which claims priority to Korean Application No. 10-2015-0096634, filed Jul. 7, 2015, the entire contents of each of which are hereby incorporated by reference.

TECHNICAL FIELD

The present invention relates to a ship collision prevention system and a method for preventing collision with other ship or obstacles during the navigation of a ship, and more particularly, to a ship collision avoidance guiding system using time series graphic display which is configured to represent changes in a relative distance according to a time with respect to respective ships at sea within a predetermined range and obstacles such as bridges in a time series graph and display a left and right positional relationship of each ship to easily identify the position of the ship nearby at sea and obstacles, a crossing time, and whether the ship is to be avoided at a glance to help to quickly and accurately judge the situation in order to solve the problems of a conventional electronic chart display and information system (ECDIS) and navigation systems using the same which have a disadvantage in that various pieces of information are simply enumerated on a screen, which causes complex and unintuitive screen display so that it is difficult to quickly identify desired information.

Further, as described above, in order to solve the problems of a conventional electronic chart display and information system (ECDIS) and navigation systems using the same which have a disadvantage in that various pieces of information are simply enumerated on a screen so that it is difficult to quickly identify desired information, the present invention relates to a ship collision avoidance guiding system using time series graphic display which is configured to calculate changes in relative distance according to a time with respect to respective ships and obstacles on the basis of the current position and a moving speed of ships or nearby obstacles such as bridges based on information provided from the electronic chart display and information systems (ECDIS) and a radar system to represent the changes in relative distance in a time series graph and further in the case of a ship, display whether the ship is on portside or starboard on the basis of radar information, and when the relative distance with a specific ship is equal to or less than a predetermined threshold value, notify avoidance to the ship having the obligation to keep out of the way through an alarm, thereby identifying the position of the ship nearby at sea and the obstacle, a crossing time, and whether the ship is to be avoided and effectively preventing the collision between ships at sea.

Further, as described above, the present invention relates to a ship collision avoidance guiding system using a time series graph display which is configured to easily identify positions of ships at sea and obstacles, a crossing time, and whether the ship is to be avoided and effectively prevent collision, and enable simulation for a crossing event and avoidance by inputting an arbitrary value so that it is possible to quickly and accurately determine whether to avoid when a navigation route for avoidance is planned in a short distance.

BACKGROUND ART

Recently, during the navigation of ships, various electronic navigation devices are mounted in a ship so that electronic navigational chart (ENC) is broadly used instead of paper maps or charts of the related art.

Such an electronic navigational chart (ENC) is produced according to a digital waterway data exchange standard S-57 established by International Hydrographic Organization (IHO) and is configured to transmit data produced according to S-57 to different types of computers according to ISO/IEC 8211 regulation.

Further, generally, even though the electronic chart display and information systems (ECDIS) which are mounted in a large size ship may use the electronic navigation chart as it is, a database of the electronic navigation chart is optimized for every purpose in order to use the electronic navigation chart for a simplified electronic chart system (ECS), which is mounted on a small or medium size ship, a ship automatic tracking apparatus (ATA), a GPS plotter, or a mobile navigation device.

Therefore, recently, ships are navigating with an electronic navigation system for determining a route using the electronic navigation chart and preventing collision with other ship mounted therein.

To be more specific, as an example of the related art of the electronic navigation chart as described above and a ship navigation and collision prevention system using the same, for example, according to Korean Registered Patent No. 10-0562216, a simplified electronic navigation chart producing method for a ship automatic tracking system using an international electronic navigation chart which performs a step of separately storing data of the electronic navigation chart in a memory for every record; a step of optimizing data set descriptive records (DDR) which describe a data structure and a definition among the data stored in the memory; a step of optimizing meta records indicating confirmation of general information of data, general information on a data structure, and parameter information required to interpret data; a step of optimizing a record reader and directory including information such as a method of reading contents included in each field of the electronic navigation and a size thereof; a step of optimizing a feature object identifier (FOID) of a feature record which is a field assigning an unique identifier in the world for an object indicated by the record; and a step of optimizing a vector record attribute field (ATTV) of a vector record representing an attribute of space information to produce an optimized electronic navigation chart which can be mounted in a tracking device, a navigation device, a black box device, or a mobile navigation device of a medium or small size ship to be used has been suggested.

Further, as another example of the related art of the electronic navigation chart as described above and a ship navigation and collision prevention system using the same, for example, according to Korean Registered Patent No. 10-1275277, an avoidance route searching support system of a ship in a navigable route by using a technique of generating a quadrangular unit route which is configured to include an input unit which receives electronic navigation chart information, navigation information of own ship and other ship, and own ship's scheduled route; a calculating unit which generates a quadrangular unit route in a navigable route according to the electronic navigation chart information, the navigation information, and own ship's scheduled route input to the input unit and calculates an avoidance route in the quadrangular unit route; and a display unit which displays the avoidance route calculated in the calculating unit on the electronic navigation chart to search the avoidance route in the navigable route when a ship enters or departs along the navigable route near the coast, if there is a risk of collision with the coastline, invasion of the route, and collision with other ships has been suggested.

Further, as another example of the related art of the electronic navigation chart as described above and a ship navigation and collision prevention system using the same, for example, according to Korean Registered Patent No. 10-1376928, a navigation aids arrangement system and method on the basis of an electronic navigation chart which is configured to arrange and verify an optimal navigation aids by configuring an electronic navigation chart based graphic user interface (GUI) and multilaterally analyze and arrange various attribute data of aids to navigation such as a character of light, a height of light, and visibility of light has been suggested.

Moreover, as another example of the related art of the electronic navigation chart as described above and a ship navigation and collision prevention system using the same, for example, according to Korean Patent Laid-open Publication No. 10-2015-0050766, a collision risk recognition and collision avoidance supporting device based on ECDIS configured to include an electronic navigation chart which collects a position and surrounding geographical information of a ship at sea to display the collected information on a display to set a route based on a GPS and a support unit which supports collision avoidance of the ship by recognizing a dangerous object on the electronic navigation chart and displaying an avoidance route to support a decision of an operator by supporting automatic recognition of a dangerous object on a given route through automatic recognition on other ship's information from an automatic recognizing device and a dangerous object list on the electronic navigation chart and an avoidance route in consideration of a passage width has been suggested.

As described above, even though various technical matters of the electronic navigation chart and a navigation guidance and collision prevention system of a ship using the same of the related art have been suggested, the electronic navigation chart and systems using the same of the related art as described above have the following problems.

To be more specific, the electronic chart display and information systems (ECDIS) and the navigation systems using the same of the related art simply enumerate various navigation information such as information on a navigation route or surrounding areas and a distance from other ship on the electronic navigation chart with respect to a value at a corresponding time. Therefore, there is a disadvantage in that the screen configuration is complex and it is difficult to identify a changing tendency according to a time so that it is not easy for a navigation officer to quickly and accurately only desired information through the screen at a glance.

Further, the electronic chart display and information systems (ECDIS) and the navigation systems using the same of the related art simply display enumerate various navigation information such as information on a navigation route or surrounding areas and a distance from other ship on a screen. Therefore, for example, when the ship approaches a specific ship with a predetermined distance or shorter, a function of generating a warning to a ship which has an avoidance obligation to effectively prevent collision in advance and determining an optimal route through a simulation when the avoidance route is determined has not been suggested.

Therefore, as described above, in order to solve the problems of the electronic chart display and information systems (ECDIS) and the navigation systems using the same of the related art which have a disadvantage in that various navigation information is simply enumerated and displayed on the ENC so that it is difficult to quickly and accurately recognize only desired information at a glance and a function of generating a warning to a ship having an obligation to keep out of the way to effectively prevent collision is not considered, it is desirable to provide a ship collision avoidance guiding system using a time series graphic display with a new configuration which is configured to simply and intuitively represent a relative distance according to a time with respect to respective ships at sea within a predetermined range and nearby obstacles to be easily recognized at a glance to help to quickly and accurately judge a situation and generate a warning to a ship having an obligation to keep out of the way at the time of approaching in a predetermined distance or shorter to effectively prevent collision in advance and determine whether to avoid through simulation and determine an optimal avoidance route. However, devices or methods which satisfy all of the above-described requirements have not been suggested.

PRIOR ART DOCUMENTS

1. Korean Registered Patent No. 10-0562216 (2006 Mar. 13)
2. Korean Registered Patent No. 10-1275277 (2013 Jun. 10)
3. Korean Registered Patent No. 10-1376928 (2014 Mar. 14)
4. Korean Patent Laid-open Publication No. 10-2015-0050766 (2015 May 11)

DISCLOSURE

Technical Problem

The present invention has been made to solve the problems of the related art as described above and thus an object of the present invention is to provide a ship collision avoidance guiding system using time series graphic display which is configured to represent changes in a relative distance according to time with respect to respective ships at sea within a predetermined range and obstacles such as bridges in a time series graph and display a left and right positional relationship of each ship to easily identify the position of the ship nearby at sea and obstacles, a crossing time, and whether the ship is to be avoided at a glance to help to quickly and accurately judge the situation in order to solve the problems of a conventional electronic chart display and information system (ECDIS) and navigation systems using the same which have a disadvantage in that various pieces of information are simply enumerated on a screen, which causes complex and unintuitive screen display so that it is difficult to quickly identify desired information.

Further, as described above, in order to solve the problems of a conventional electronic chart display and information system (ECDIS) and navigation systems using the same which have a disadvantage in that various pieces of information are simply enumerated on a screen so that it is difficult to quickly identify desired information, another object of the present invention is to provide a ship collision avoidance guiding system using time series graphic display which is configured to calculate changes in relative distance with a ship according to a time with respect to respective ships and obstacles on the basis of the current position and a moving speed of ships or nearby obstacle such as bridges based on information provided from the electronic chart display and information systems (ECDIS) and a radar system to represent the changes in relative distance in a time series graph and further, in the case of a ship, display whether the ship is on portside or starboard on the basis of radar information, and when the relative distance with a specific ship is equal to or less than a predetermined threshold value, notify avoidance to the ship having the obligation to keep out of the way through an alarm, thereby identifying the position of the ship nearby at sea and the obstacles, a crossing time, and whether the ship is to be avoided and efficiently preventing the collision between ships at sea and the collision between a ship and an obstacle.

Moreover, still another object of the present invention is to provide a ship collision avoidance guiding system using time series graphic display which is configured to easily identify positions of ships at sea and obstacles, a crossing time, and whether the ship is to be avoided and effectively prevent collision, and enable simulation for a crossing event and avoidance by inputting an arbitrary value so that it is possible to quickly and accurately determine whether to avoid when a sea way for avoidance is planned in a short distance.

Technical Solution

In order to achieve the above-described object, according to the present invention, there is provided a ship collision avoidance guiding system using time series graphic display for solving the problems of a conventional electronic chart display and information system (ECDIS) and navigation systems using the same which have a disadvantage in that various pieces of information are simply enumerated on a screen, which causes complex and unintuitive screen display so that it is difficult to quickly identify desired information, in which the system includes: a crossing and avoidance information providing unit configured to perform a processing of representing a relative positional relationship with respect to ships at sea within a predetermined range and obstacles and collision possibility in a time series graph; a display which displays information generated through the crossing and avoidance information providing unit; an alarm generating unit which transmits notification for avoidance based on the information provided by the crossing and avoidance information providing unit; a communication unit which performs communication with external equipment and other ships; and a control unit which controls an overall operation and function of the ship collision avoidance guiding system, in which changes in a relative distance according to a time with respect to respective ships and obstacles are represented through a time series graph and a left and right positional relationship of the respective ships are displayed to easily identify positions of the ships and obstacles, a crossing time, and whether the ship is to be avoided at a glance.

Here, when it is assumed that an X axis is a time and a Y axis is a distance, the crossing and avoidance information providing unit may be configured to perform a processing of creating changes in a relative position according to a time with respect to the ships and obstacles as a graph to be displayed, based on information provided from an electronic chart display and information system (ECDIS) and a radar system.

Further, the crossing and avoidance information providing unit may be configured to perform a processing of creating changes in a relative position according to a time with respect to the ships and obstacles as a graph to be displayed and also displaying navigation information including a relative bearing angle of the other ship with respect to the own ship at a close point and a closest point, a traveling direction, a close distance, and a closing time and a collision limit line representing a threshold value for avoidance to easily identify whether to collide with the ship and the obstacles and a risk at a glance.

Moreover, the crossing and avoidance information providing unit may be configured to perform a processing of displaying the changes in a relative distance according to a time with respect to the ship and the obstacles, the navigation information, and the collision limit line and displaying a left and right positional relationship between the respective ships using radar information to easily identify a ship having an obligation to keep out of the way.

Here, the crossing and avoidance information providing unit may be configured to display the left and right positional relationship between the ships with English characters L and R or using at least one of a color of the graph, a character, and a symbol.

When a graph for a specific ship or obstacle is located below the collision limit line, it is determined that there is a collision risk with the ship or obstacle based on a result generated by the crossing and avoidance information providing unit, when a ship determined to have the collision risk is located on the left, avoidance is notified to the ship located on the left through the alarm generating unit and the communication unit, and, when the ship determined to have a collision risk is located on the right, a processing of generating an avoidance warning to own ship is automatically performed by the alarm generating unit, so that collision between ships and collision between a ship and an obstacle are effectively prevented.

Alternatively, the ship collision avoidance guiding system may be configured to perform a processing of automatically notifying avoidance to all ships having the collision risk when it is determined that there is the collision risk.

When a number of ships or obstacles to be displayed exceed a predetermined range, the ship collision avoidance guiding system may be configured to selectively display only a graph for ships or obstacles corresponding to a criteria based on a predetermined criteria or enlarge or reduce the graph to increase legibility.

The ship collision avoidance guiding system may further include an input unit for inputting navigation information including a route and a speed of a ship to perform simulation for a crossing event and avoidance through the crossing and avoidance information providing unit and the crossing and avoidance information providing unit may be configured to reconfigure the relative positional relationship and collision possibility for the ship and the obstacles according to the navigation information input through the input unit to create the graph and display the graph through the display so that when an avoidance route is determined, whether to collide is quickly and accurately determined through a simulation for a crossing event and avoidance to effectively prevent collision between ships and collision between a ship and an obstacle.

The ship collision avoidance guiding system may be configured by installing a dedicated program or processing module configured to display the graph in an existing ship navigation guiding system or ship collision preventing system to be easily implemented at a low cost without configuring a separate hardware.

Further, according to the present invention, there is provided a ship collision avoidance guiding method using time series graphic display for solving the problems of a conventional electronic chart display and information system (ECDIS) and ship collision avoiding methods using the same which have a disadvantage in that various pieces of information are simply enumerated on a screen, which causes complex and unintuitive screen display so that it is difficult to quickly identify desired information, which is configured to provide information on a relative position for respective ships at sea within a predetermined range and obstacles, a crossing time, and whether the ship is to be avoided using the above-described ship collision avoidance guiding system using a time series graphic display so that the position for the ship and the obstacles, the crossing time, and whether the ship is to be avoided are easily identified and when an avoidance route is determined, whether to collide is quickly and accurately determined through a simulation for a crossing event and avoidance to effectively prevent collision between ships and collision between a ship and an obstacle.

According to the present invention, there is provided a ship which is configured to include the above-described ship collision avoidance guiding system using the time series graphic display, in which the relative position for the ship at sea within a predetermined range and the obstacles, the crossing time, and whether the ship is to be avoided are easily identified and when an avoidance route is determined, whether to collide is quickly and accurately determined through a simulation for a crossing event and avoidance.

Advantageous Effects of Invention

As described above, according to the present invention, a ship collision avoidance guiding system using a time series graphic display which is configured to represent changes in a relative distance according to a time with respect to respective ships at sea within a predetermined range and obstacles in a time series graph and display a left and right positional relationship of each ship to easily identify the position of the ship nearby at sea and obstacles, a crossing time, and whether the ship is to be avoided at a glance to help to quickly and accurately judge the situation is provided, so that it is possible to solve the problems of a conventional electronic chart display and information system (ECDIS) and navigation systems using the same which have a disadvantage in that various pieces of information are simply enumerated on a screen, which causes complex and unintuitive screen display so that it is difficult to quickly identify desired information.

Further, according to the present invention, a ship collision avoidance guiding system using time series graphic display which is configured to calculate changes in relative distance with a ship according to a time with respect to respective ships and obstacles based on information provided from the electronic chart display and information systems (ECDIS) and a radar system to represent the changes in relative distance in a time series graph and further, in the case of a ship, display whether the ship is on portside or starboard on the basis of radar information, and when the relative distance with a specific ship is equal to or less than a predetermined threshold value, notify avoidance to the ship having the obligation to keep out of the way through an alarm is provided, so that it is possible to identify the position of the ship nearby at sea and the obstacles, a crossing time, and whether the ship is to be avoided and efficiently prevent the collision between ships at sea and the collision between a ship and an obstacle.

Moreover, according to the present invention, a ship collision avoidance guiding system using time series graphic display which is configured to easily identify positions of ships at sea and obstacles, a crossing time, and whether the ship is to be avoided and effectively prevent collision, and enable simulation for a crossing event and avoidance by inputting an arbitrary value is provided so that it is possible to quickly and accurately determine whether to avoid when a sea way for avoidance is planned in a short distance.

DESCRIPTION OF DRAWINGS

FIG. 1 is a view schematically illustrating a display example of an electronic navigation chart screen displayed on an electronic chart display and information systems (ECDIS) of the related art.

FIG. 2 is a view schematically illustrating a display example of an electronic navigation chart screen displayed on an electronic chart display and information systems (ECDIS) of the related art.

FIG. 3 is a view schematically illustrating a display example of a time series interface display screen for collision avoidance of a ship which is displayed by a ship collision avoidance guiding system using time series graphic display according to an exemplary embodiment of the present invention.

FIG. 4 is a view schematically illustrating an overall configuration of a ship collision avoidance guiding system using time series graphic display according to an exemplary embodiment of the present invention.

BEST MODE

Hereinafter, a specific exemplary embodiment of a ship collision avoidance guiding system using time series graphic display according to the present invention will be described with reference to the accompanying drawings.

Here, it should be noted that the following description is merely one exemplary embodiment to carry out the present invention, but the present invention is not limited to the exemplary embodiments which will be described below.

Further, it should be noted that in the following description of the exemplary embodiment of the present invention, when it is determined that a portion is the same as or similar to those of the related art or easily understood and carried out by those skilled in the art, detailed description thereof will be omitted for simplifying the description.

That is, as it will be described below, the present invention relates to a ship collision avoidance guiding system using time series graphic display which is configured to represent changes in a relative distance according to a time with respect to respective ships at sea within a predetermined range and obstacles in a time series graph and display a left and right positional relationship of each ship to easily identify the position of the ship nearby at sea and obstacles, a crossing time, and whether the ship is to be avoided at a glance to help to quickly and accurately judge the situation in order to solve the problems of a conventional electronic chart display and information system (ECDIS) and navigation systems using the same which have a disadvantage in that various pieces of information are simply enumerated on a screen, which causes complex and unintuitive screen display so that it is difficult to quickly identify desired information.

Further, as it will be described below, in order to solve the problems of a conventional electronic chart display and information system (ECDIS) and navigation systems using the same which have a disadvantage in that various pieces of information are simply enumerated on a screen so that it is difficult to quickly identify desired information, the present invention relates to a ship collision avoidance guiding system using time series graphic display which is configured to calculate changes in a relative distance according to a time with respect to respective ships and obstacles based on information provided from the electronic chart display and information systems (ECDIS) and a radar system to represent the changes in relative distance in a time series graph and, in the case of a ship, further display whether the ship is on portside or starboard on the basis of radar information, and when the distance from a specific ship is equal to or less than a predetermined threshold value, notify avoidance to the ship having the obligation to keep out of the way through an alarm, thereby identifying the position of the ship nearby at sea and the obstacles, a crossing time, and whether the ship is to be avoided and efficiently preventing the collision between ships at sea and the collision between a ship and an obstacle.

Moreover, as it will be described below, the present invention relates to a ship collision avoidance guiding system using time series graphic display which is configured to easily identify positions of ships at sea and obstacles, a crossing time, and whether the ship is to be avoided and effectively prevent collision, and enable simulation for a crossing event and avoidance by inputting an arbitrary value so that it is possible to quickly and accurately determine whether to avoid when a route for avoidance is planned in a short distance.

Continuously, a ship collision avoidance guiding system using time series graphic display according to the present invention will be specifically described with reference to the drawings.

First, referring to FIGS. 1 and 2, FIGS. 1 and 2 are views schematically illustrating a display example of an electronic chart screen displayed on the electronic navigation chart display and information system (ECDIS).

As illustrated in FIGS. 1 and 2, the existing electronic chart display and information systems (ECDIS) are configured to display an electronic navigation chart on a screen and various information on a route and surrounding areas on the electronic navigation chart and also display, for example, navigation guidance information for preventing collision in consideration of a route and a speed of a ship nearby at sea on the screen, like CPA or a TCPA.

Therefore, since in the case of display screens of the existing electronic chart display and information systems (ECDIS) and navigation systems using the same, various pieces of information are displayed on one screen to overlap each other, it is difficult for a navigation officer who needs to determine a route while watching the screen to intuitively check all information at a glance and thus it does not help to identify a ship which approaches at a short distance to determine a route for avoiding the collision so that it does not help when quick and accurate decision is required.

Therefore, as it will be described below, the present inventors suggest a time series graphic interface display method configured to intuitively identify whether to collide with ships nearby at sea and a height of risk only at a glance by the contents displayed on a screen of a ship collision avoidance guiding system and present a ship collision avoidance guiding system configured to effectively prevent collision between ships and collision between a ship and a nearby obstacle using the same.

That is, referring to FIG. 3, FIG. 3 is a view schematically illustrating a display example of a time series interface display screen for collision avoidance of a ship which is displayed by a ship collision avoidance guiding system using time series graphic display according to an exemplary embodiment of the present invention.

As illustrated in FIG. 3, the time series interface display method for ship collision avoidance according to the exemplary embodiment of the present invention may be configured to display changes in a relative distance with ships nearby at sea within a predetermined range and obstacles on a two-dimensional plane in which an X axis is a time and a Y axis is a distance in the form of graph.

To be more specific, on the basis of information provided from the electronic chart display and information system (ECDIS) or a radar system, as illustrated in FIG. 3, changes in a relative distance according to a time with respect to nearby ships and obstacles are displayed by a time series graph so that it is possible to easily identify how and when the respective ship or obstacle approaches or departs from the own ship and a bearing angle and a distance of the other ship at the closest moment at a glance.

That is, in the graph illustrated in FIG. 3, a value on the X axis corresponds to a time t and a value on the Y axis corresponds to a distance d and the graph illustrated in FIG. 3 represents changes in a relative distance according to a time with respect to respective ships and obstacles.

Here, in order to calculate changes in a relative distance with own ship according to a time with respect to respective ships and obstacles, a position and a speed at a present time of the ship or the obstacle provided by the electronic chart display and information system (ECDIS) and the radar system may be utilized.

To be more specific, when it is represented using a concept of a vector operation, if it is assumed that a current position of the own ship is $P_{own}(0)$, a current position of the other ship or obstacle is $P_{target}(0)$, a current speed of the own ship is $V_{own}$, and a current speed of the other ship or obstacle is $V_{target}$, a relative position P(t) between the own ship and the other ship or obstacle after t seconds may be calculated by the following [Mathematical Formula 1].

$$P(t)=\{P_{target}(0)-P_{own}(0)\}+(V_{target}-V_{own})\times t \quad \text{[Mathematical Formula 1]}$$

Further, when P(t) calculated using the above [Mathematical Formula 1] is utilized, the relative distance |P(t)| between the own ship and the other ship or obstacle after t seconds may be represented by the following [Mathematical Formula 2].

$$|P(t)|=|\{P_{target}(0)-P_{own}(0)\}+(V_{target}-V_{own})\times t| \quad \text{[Mathematical Formula 2]}$$

Accordingly, a value of (t, |P(t)|) is calculated using [Mathematical Formula 1] and [Mathematical Formula 2] so that changes in the relative distance according to a time with respect to the other ship or obstacle will be represented by a graph.

Further, it is obvious that a relative bearing angle of the other ship with respect to the own ship at the closest point is easily calculated by utilizing a value of P(t) calculated in [Mathematical Formula 1].

Here, even though in the exemplary embodiment of the present invention, the present invention has been described with an example in which the relative distance |P(t)| is calculated using [Mathematical Formula 1] and [Mathematical Formula 2], the present invention is not necessarily limited thereto. That is, it should be noted that in addition to a method of using [Mathematical Formula 1] and [Mathematical Formula 2], for example, in order to calculate the value of |P(t)|, various methods may be utilized as needed, such as a method of utilizing navigation route information of the opponent received from the opponent.

Further, in addition to displaying changes in relative distance with respect to the respective ships and obstacles in time series manner as described above, the ship collision avoidance guiding system using time series graphic display according to an exemplary embodiment of the present invention may easily identify whether to collide with respective ships and obstacles and risk by displaying information such as a relative bearing angle of the other ship with respect to the own ship, a traveling direction, a close distance, and a closing time and also displaying a collision limit line representing a threshold value for avoidance, as illustrated in FIG. 3.

That is, when the graph is located below the limit line, it means that there is a high risk of collision. Therefore, as illustrated in FIG. 3, information such as figures and symbols displayed on the graph is identified to identify the relative bearing angle, the traveling direction, a close distance, and a closing time of the other ship with respect to the own ship at a close point and the closest point to determine an avoidance route in advance and avoid and in the case of the ship, a warning is sent to the ship in advance so that accident may be prevented in advance.

In this case, generally, when the ship is at sea, a ship which is located on the left needs to avoid. Therefore, as illustrated in FIG. 3, a left and right positional relationship between the ships is also displayed using radar information so that it is also easily understood that which ship needs to be avoided first at a glance.

Here, in the display example illustrated in FIG. 3, the left and right positional relationship between the respective ships are marked in a table by English characters L and R and a relative bearing angle in 12-hour unit, but the present invention is not necessarily limited thereto. That is, it should be noted that in the present invention, the display of the left and right positional relationship between the respective ships may be configured by various methods as needed, for example, may be represented using colors, characters, or symbols of the graph.

Further, a series of processing of determining whether to collide to notify a warning to a ship having an obligation to keep out of the way may be automatically performed by the ship collision avoidance guiding system.

To be more specific, it is understood that in the display example illustrated in FIG. 3, both a graph of a ship 1 and a graph of a ship 2 are located below the collision limit line, so that there is a risk of collision and in contrast, a ship 3 is not located below the collision limit line so that there is no risk of collision.

Further, in the display example illustrated in FIG. 3, the ship 1 crosses before the ship 2, so that the ship 1 needs to be preferentially avoided. In this case, since the ship 1 is located on the left, the ship 1 is a ship having an obligation to keep out of the way so that the ship 1 needs to be avoided. Therefore, to this end, a signal for notifying avoidance is transmitted to the ship 1.

In contrast, with respect to the ship 2, the ship 2 crosses after the ship 1, but the ship 2 is located on the right. Therefore, it is easily identified that the own ship needs to be avoided with respect to the ship 2 and thus an alarm is generated to the own ship to notify avoidance to a navigation officer.

Here, even though in the exemplary embodiment illustrated in FIG. 3, the present invention is described with an example in which crossing and avoidance information is provided to a total of three ships, for the purpose of brief description, generally, there may be actually more ships or obstacles at the surrounding. Therefore, when a large number of ships or obstacles are displayed on one screen, legibility is deteriorated so that quick situation judgement may be disturbed.

To this end, the present invention may be configured such that when a number of ships or obstacles to be displayed exceed a predetermined range, for example, only ships or obstacles corresponding to a criteria are selectively displayed based on a predetermined criteria such as an order in which collision occurs most quickly or a higher order of collision risk or the graph is enlarged or reduced to increase legibility.

Therefore, from the above-described configuration, when the time series interface display method for ship collision avoidance according to an exemplary embodiment of the present invention is used, changes in a relative distance according to a time with respect to the respective ships at sea within a predetermined range and obstacles is represented through a time series graph and in this case, in the case of a ship, a left and right positional relationship of each ship is also displayed to easily identify positions of a ship nearby at sea and obstacles and crossing time and whether the ship is to be avoided at a glance, which helps to quickly and accurately judge a situation. Further, when a distance with a specific ship or obstacle is below a predetermined threshold value, avoidance is notified to a ship having an obligation to keep out of the way through an alarm to effectively prevent collision between ships and collision between ships and obstacles.

Here, as the above-described avoidance notification, the avoidance notification is notified not only to the ship having an obligation to keep out of the way, but also to all of the ships having an obligation to keep out of the way and ships which do not have obligation to keep out of the way to cause both sides to watch the progress of avoidance so that the collision may be more effectively prevented.

Moreover, the ship collision avoidance guiding system according to the exemplary embodiment of the present invention may be configured to enable simulation for whether to collide by inputting a random value.

That is, in order to determine an avoidance route, the ship collision avoidance guiding system according to the exemplary embodiment of the present invention may be configured such that for example, when navigation information such as a route or a speed of a ship is input, like a case of turning to a starboard at a predetermined angle, a time series graph as newly illustrated in FIG. 3 is created according to the input navigation information to be displayed on the screen.

Therefore, from the configuration as described above, when an avoidance route is set in a short distance through a simulation for a crossing event and avoidance, it is possible to easily identify whether to collide to quickly and accurately respond thereto and thus it is further possible to effectively prevent the collision between ships and collision between ships and obstacles.

To be more specific, referring to FIG. 4, FIG. 4 is a view schematically illustrating an overall configuration of a ship collision avoidance guiding system 40 using a time series graphic display according to an exemplary embodiment of the present invention.

As illustrated in FIG. 4, as described above with reference to FIG. 3, a ship collision avoidance guiding system 40 using a time series graphic display according to an exemplary embodiment of the present invention may be configured to largely include a crossing and avoidance information providing unit 41 which represents a relative positional relationship of ships nearby at sea and obstacles and collision possibility by a time series graph, an input unit 42 which inputs various pieces of navigation information for performing a simulation for a crossing event and avoidance through the crossing and avoidance information providing unit 41, a display unit 43 which displays information generated through the crossing and avoidance information providing unit 41, a communication unit 44 which performs communication with external equipment and other ship, an alarm generating unit 45 which transmits a notification for avoidance to own ship and nearby ships, and a control unit 46 which controls an overall operation and function of each unit.

Here, as described above with reference to FIG. 3, the crossing and avoidance information providing unit 41 may be configured to perform a processing of representing a relative positional relationship with respect to ships nearby at sea and obstacles and collision possibility in a time series graph.

Further, the above-described crossing and avoidance information providing unit 41 may be configured to perform a processing of reconfiguring a relative positional relationship with respect to ships nearby at sea and obstacles according to a value input through the input unit 42 to be represented by the time series graph as illustrated in FIG. 3.

Further, as described with reference to FIG. 3, when there is a collision risk, the above-described alarm generating unit 45 may be configured to automatically notify avoidance to a ship having an obligation to keep out of the way or both ships based on the result generated by the crossing and avoidance information providing unit 41.

Moreover, the ship collision avoidance guiding system 40 using a time series graphic display according to an exemplary embodiment of the present invention may be configured as a separate independent device as illustrated in FIG. 4, but is not necessarily limited to such a configuration. That is, it should be noted that the ship collision avoidance guiding system 40 using a time series graphic display according to the present invention may be configured by installing a dedicated program or processing module configured to display a time series graphic interface in an existing navigation system as described with reference to FIG. 3 or may be configured in various manners as needed.

Accordingly, the ship collision avoidance guiding system 40 using a time series graphic display according to the present invention may be implemented as described above.

Further, by implementing the ship collision avoidance guiding system using a time series graphic display according to the present invention as described above, according to the present invention, the ship collision avoidance guiding system using a time series graphic display which is configured to represent changes in a relative distance according to a time with respect to respective ships at sea within a predetermined range and obstacles in a time series graph and display a left and right positional relationship of each ship to easily identify the position of the ship nearby at sea and obstacles, a crossing time, and whether the ship is to be avoided at a glance to help to quickly and accurately judge the situation is provided so that the problems of a conventional electronic chart display and information system (ECDIS) and navigation systems using the same which have a disadvantage in that various pieces of information are simply enumerated on a screen, which causes complex and unintuitive screen display so that it is difficult to quickly identify desired information may be solved.

Further, according to the present invention, a ship collision avoidance guiding system using time series graphic display which is configured to calculate changes in relative distance with a ship according to a time with respect to respective ships and obstacles based on information provided from the electronic chart display and information systems (ECDIS) and a radar system to represent the changes in relative distance in a time series graph and further, in the case of a ship, display whether the ship is on portside or starboard on the basis of radar information, and when the relative distance with a specific ship is equal to or less than a predetermined threshold value, notify avoidance to the ship having the obligation to keep out of the way through an alarm is provided, so that it is possible to identify the position of the ship nearby at sea and the obstacles, a crossing time, and whether the ship is to be avoided and efficiently prevent the collision between ships at sea.

Moreover, according to the present invention, a ship collision avoidance guiding system using time series graphic display which is configured to easily identify positions of ships at sea and obstacles, a crossing time, and whether the ship is to be avoided and effectively prevent collision, and enable simulation for a crossing event and avoidance by inputting an arbitrary value is provided so that it is possible to quickly and accurately determine whether to avoid when a sea way for avoidance is planned in a short distance.

As described above, although details of the ship collision avoidance guiding system using a time series graphic display according to the present invention have been described through the exemplary embodiment of the present invention, the present invention is not limited to the contents described in the above exemplary embodiment. Therefore, various modification, changes, combinations, and substitutions of the present invention may be allowed to those skilled in the art according to a design need and other various factors changed.

EXPLANATION OF REFERENCE NUMERALS AND SYMBOLS

40. Ship collision avoidance guiding system
41. Crossing and avoidance information providing unit
42. Input unit
43. Display
44. Communication unit
45. Alarm generating unit
46. Control unit

The invention claimed is:

1. A ship collision avoidance guiding system using time series graphic display, the system comprising:

a crossing and avoidance information providing unit configured to process a representation of a relative positional relationship with respect an own ship to ships and obstacles at sea within a predetermined range and collision possibility in a time series graph;

a display configured to display information generated through the crossing and avoidance information providing unit;

an alarm generating unit configured to transmit a notification for avoidance based on the information provided by the crossing and avoidance information providing unit;

a communication unit configured to communicate with external equipment and other ships; and a control unit configured to control an overall operation and function of the ship collision avoidance guiding system, wherein changes in a relative distance according to a time with respect to respective ships and obstacles are represented through a time series graph and a left and right positional relationship of the respective ships is displayed to identify positions of the ships and obstacles, a crossing time, and whether the ship is to be avoided, wherein the crossing and avoidance information providing unit is configured to process a representation of the relative positional relationship based on information provided from an electronic chart display and information system (ECDIS) and a radar system, wherein the crossing and avoidance information providing unit is configured to process changes in the relative position of the ships and obstacles according to time as a graph to be displayed and the displayed navigation information includes a relative bearing angle of the other ship with respect to the own ship at a close point and a closest point, a traveling direction, a close distance, a closing time and a collision limit line representing a threshold value for avoidance, the collision limit line and displaying a left and right positional relationship between the respective ships using radar information to identify a ship having an obligation to keep out of the way, wherein the display is configured to display the left and right positional relationship between the ships with English characters L and R or using at least one of a color of the graph, a character, and a symbol, and wherein when a graph for a specific ship or obstacle is located below the collision limit line, it is determined that there is a collision risk with the ship or obstacle based on a result generated by the crossing and avoidance information providing unit, when a ship determined to have the collision risk is located on the left, avoidance is notified to the ship located on the left through the alarm generating unit and the communication unit, and when the ship determined to have a collision risk is located on the right, a processing of generating an avoidance warning to own ship is automatically performed by the alarm generating unit.

2. The system of claim 1, wherein the ship collision avoidance guiding system is configured to perform a processing of automatically notifying avoidance to all ships having the collision risk when it is determined that there is the collision risk.

3. The system of claim 2, wherein when a number of ships or obstacles to be displayed exceed a predetermined range, the ship collision avoidance guiding system is configured to selectively display only a graph for ships or obstacles corresponding to a criteria based on a predetermined criteria or enlarge or reduce the graph to increase legibility.

4. The system of claim 3, wherein the crossing and avoidance information providing unit is configured to reconfigure the relative positional relationship and collision possibility for the ship and the obstacles according to the navigation information input to create the graph and display the graph through the display so that when an avoidance route is determined, whether to collide is determined through a simulation for a crossing event and avoidance to effectively prevent collision between ships and collision between a ship and an obstacle.

5. The system of claim 4, wherein the ship collision avoidance guiding system is configured by installing a dedicated program or processing module configured to display the graph in an existing ship navigation guiding system or ship collision preventing the system to be easily implemented at a law-east without configuring a separate hardware.

6. A ship collision avoidance guiding method using time series graphic display the method comprising:

processing a representation of a relative positional relationship with respect an own ship to ships and obstacles at sea within a predetermined range and collision possibility in a time series graph, the processing the representation of the relative positional relationship is based on information provided from an electronic chart display and information system (ECDIS) and a radar system;

displaying the representation of the relative positional relationship;

transmitting a notification for avoidance based on the representation of the relative positional relationship;

communicating with external equipment and other ships;

controlling an overall operation and function of a ship collision avoidance guiding system;

processing changes in a relative distance according to a time with respect to respective ships and obstacles;

representing changes in the relative distance of the ships and obstacles through a time series graph and a left and right positional relationship of the respective ships;

displaying the relative distance of the ships and obstacles to identify positions of the ships and obstacles, a crossing time, and whether the ship is to be avoided, the displaying the relative distance including displaying the left and right positional relationship between the ships with English characters L and R or using at least one of a color of the graph, a character, and a symbol wherein the processing changes in the relative position of the ships and obstacles according to time includes processing as the relative position as a graph to be displayed and the navigation information to be displayed includes a relative bearing angle of the other ship with respect to the own ship at a close point and a closest point, a traveling direction, a close distance, a closing time and a collision limit line representing a threshold value for avoidance, the collision limit line and displaying a left and right positional relationship between the respective ships using radar information to identify a ship having an obligation to keep out of the way, and wherein the processing a representation of the relative positional relationship includes determining that there is a collision risk with the ship or obstacle when a graph for a specific ship or obstacle is located below the collision limit line, notifying a ship located on the left when the ship located on the left is determined to have the collision risk, and generating an avoidance warning to own ship when the ship determined to have the collision risk is located on the right.

7. A ship which is configured to include the ship collision avoidance guiding system using a time series graphic display of claim 1.

* * * * *